US005423297A

United States Patent [19]

Roberts

[11] Patent Number: 5,423,297

[45] Date of Patent: Jun. 13, 1995

[54] TWO STAGE ROTARY VANED INTERNAL COMBUSTION ENGINE

[76] Inventor: Donald M. Roberts, 207, 6217 - 48A Avenue, Camrose, Alberta, Canada, T4V 2Y3

[21] Appl. No.: 220,177

[22] Filed: Mar. 30, 1994

[30] Foreign Application Priority Data

Aug. 31, 1993 [CA] Canada ..... 2,105,196

[51] Int. Cl.[6] ..... F02B 53/08

[52] U.S. Cl. ..... 123/213; 123/236; 418/111

[58] Field of Search ..... 123/213, 236, 237, 238, 123/243; 418/101, 111, 120, 121, 124

[56] References Cited

U.S. PATENT DOCUMENTS

| | | | |
|---|---|---|---|
| 1,256,996 | 2/1918 | George | 123/236 |
| 1,267,157 | 5/1918 | Zabriske . | |
| 1,757,484 | 5/1930 | Shoemaker . | |
| 1,796,535 | 3/1931 | Rolaff | 418/111 |
| 2,435,476 | 2/1948 | Summers | 123/236 |
| 3,228,196 | 1/1966 | Paulsen | 123/236 |
| 3,895,609 | 7/1975 | Armstrong . | |
| 3,913,534 | 10/1975 | Bratten | 123/213 |
| 3,951,109 | 4/1976 | Chappellier . | |
| 3,951,111 | 4/1976 | Lester . | |
| 4,572,121 | 2/1986 | Chang . | |
| 4,662,329 | 5/1987 | Roggenburk . | |

*Primary Examiner*—Michael Koczo
*Attorney, Agent, or Firm*—Anthony R. Lambert

[57] ABSTRACT

A two stage rotary vaned internal combustion engine using cylindrical rotors that spin inside a pair of specially shaped chambers with extendable vanes that seal the space between the spinning rotor and the stationary chamber each rotor and chamber form a plurality of compression spaces connected by valves to combustion-/expansion chambers the intake flow runs along the axis of the rotors and is partially pressurized before being directed into the compression chamber where further compression takes place and compressed air is then directed through the valve body into the combustion chamber where ignition and expansion take place causing the rotor to rotate exhaust takes place simultaneously with the next ignition and expansion process. This process takes place at the same time in all chambers. This engine will operate on gasoline and alternative fuels.

8 Claims, 8 Drawing Sheets

TWO STAGE ROTARY VANED INTERNAL COMBUSTION ENGINE

FIELD OF THE INVENTION

This invention relates to rotary vaned engines.

BACKGROUND OF THE INVENTION

Conventional internal combustion engines usually employ pistons, connecting rods, heads, crankshafts, valve trains etc. These engines produce a good deal of vibration, wear and energy loss. To reduce such undesirable faults, various types of rotary engines have been proposed. These rotary engines use rotors having radial vanes cooperating with inside surfaces of cylindrical chambers or stators which are eccentrically mounted. Typical examples of such previously proposed rotary engines are shown in U.S. Pat. No. 1,757,484 to G. Shoemaker and U.S. Pat. No. 4,572,121 to Victor Chang. Both of these patents are concerned with radial motors having side by side rotors which have a valve arrangement to allow compressed air-fuel mixtures to flow from an intake compression stage to an combustion-exhaust stage. Both of these designs fire the explosive mixture at the same place on the stator, one firing per vane per revolution. This style of firing tends to give a side load to the bearings causing wear and subsequently requiring higher oil pressure and oil flow.

Shoemaker shows exposed air passages which cool the air-fuel mixture between compression and ignition. Chang's device has an exhaust problem requiring a third stage to blow the spent gasses from the engine. Also both types of engines have no means of cooling the rotor. Both engines use eccentrically mounted rotors. They can only be fired in one position in the stator. There is a need for improvement with respect to these and other shortcomings to simplify construction and operation. This invention has air flowing down the center to cool the rotors. The rotors are concentrically mounted in a lobated interior of the stator this allows all chambers to be fired simultaneously with multiple firings per revolution.

SUMMARY OF THE INVENTION

The main object of the invention is to provide an internal combustion engine which overcomes the disadvantages and shortcomings of previously proposed engines. A further object of the invention is to provide an improved rotary internal combustion engine with concentric mounted rotors mounted on a common shaft.

In one aspect of the invention, the engine includes a compression chamber housing, a valve body having first and second sides, the first side of the valve body being secured to the compression chamber housing, a combustion chamber housing secured to the second side of the valve body, a compression and intake rotor secured for rotation in the compression chamber housing on a central shaft, and a combustion and exhaust rotor secured for rotation in the combustion chamber housing on the central shaft. Each rotor includes an outer surface and a plurality of radially disposed vanes extendable radially beyond the outer surface. Each vane is slidable within the rotor under centrifugal forces during rotation of the rotor. Each of the combustion chamber housing and the compression chamber housing has a lobate interior formed of a plurality of lobes, one lobe for each vane. Each of the lobes may have a radius of curvature that increases in the direction of movement of the vanes. The lobe may be elliptical in shape, but may have other shapes such as a section of a spiral. Each rotor is preferably hollow and includes means to force air from the atmosphere into the combustion chamber. The means for forcing air into the combustion chamber preferably includes angled radially extending blades oriented to force air in one direction within the rotors, which blades may support the vanes.

The engine thus provides a first stage which has an intake function and compression function which forces the air through the valves into the second stage where combustion and exhaust take place. One advantage of this design is that each chamber has simultaneous combustion multiple times per revolution. For example if there were 4 chambers and 4 vanes in each stage there would be 16 firings per revolution. A further advantage is that the stator and rotor seal to each other at multiple places around the circumference of the rotor forming multiple firing chambers. The flow of air along the axis on the inside of the rotors achieves two things. It cools the rotors and also is directed through intake tubes into the engine. These innovations will produce a light motor which will be efficient, have high torque and will be able to run on most alternate fuels as well as gasoline.

In operation this motor will provide high torque, low fuel consumption and low emissions while delivering high horse power for the weight of the engine.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figure 1:
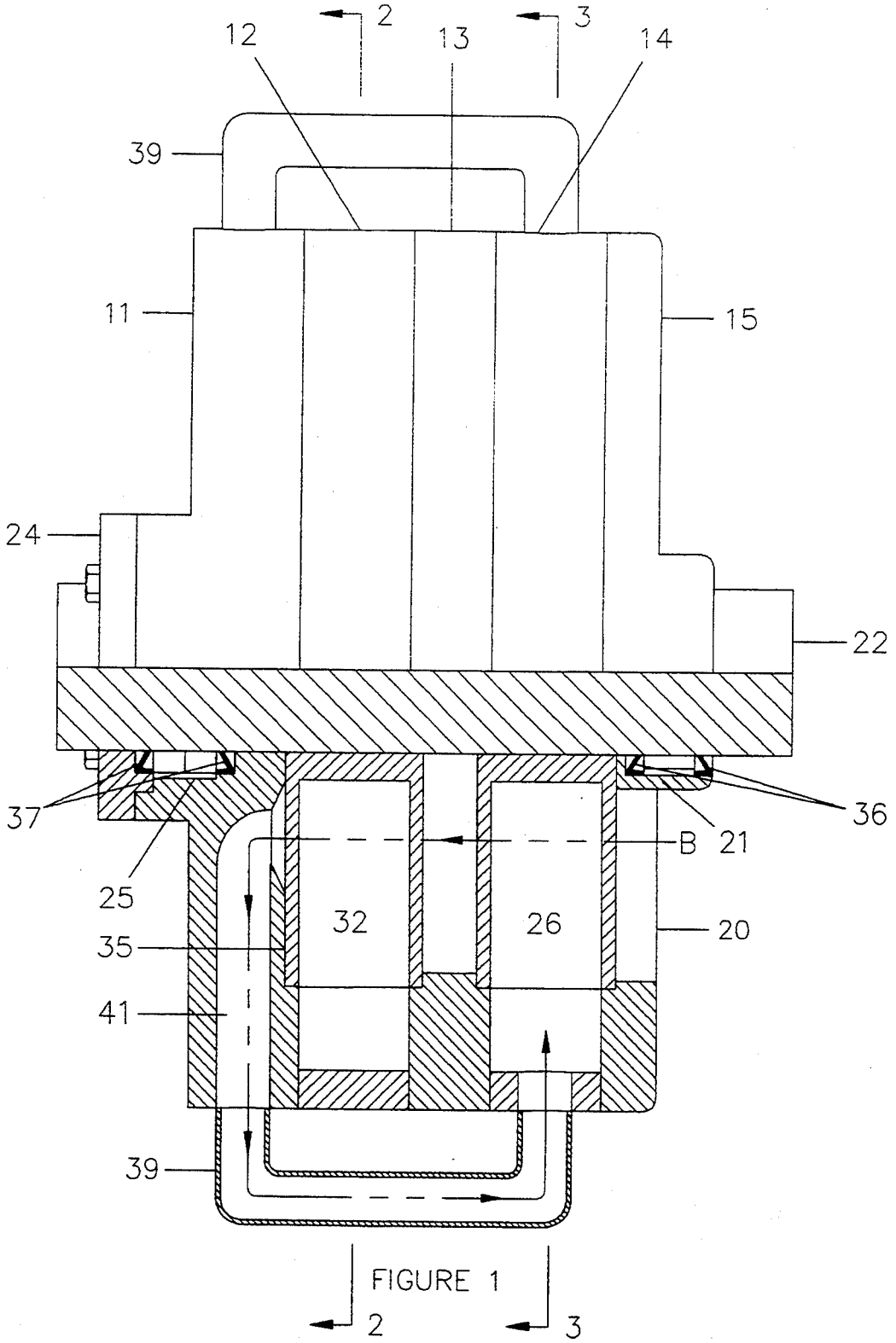
FIG. 1 is a side view of an engine according to the invention partially cut-away.

Referring to FIG. 1, there is shown a two stage rotary vaned internal combustion engine 10. The engine 10 is made up of five castings or housing sub-sections 11, 12, 13, 14 and 15 which are bolted together to form the housing for the engine 10.

Figure 10:
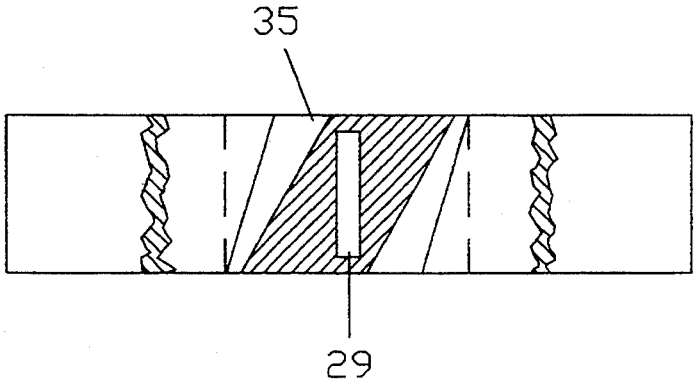
FIG. 10 is a section along the ling 10—10 in FIG. 2.

One end of the engine is formed of a casting 11 shown in FIG. 1. Casting 11 is a rear housing that houses a rear bearing 25 and bearing retainer end plate 24 and seals the rear end of the engine 10. Lip type seals 37 seal the rear bearing 25. The casting 11 acts as a collection chamber for air forced down the center of the engine 10 by the blades 35 of the rotors 26 and 32 (seen more clearly in FIGS. 2, 3 and 10). Casting 11 also seals one side of the combustion-exhaust chambers forming within casting 12.

Figure 2:
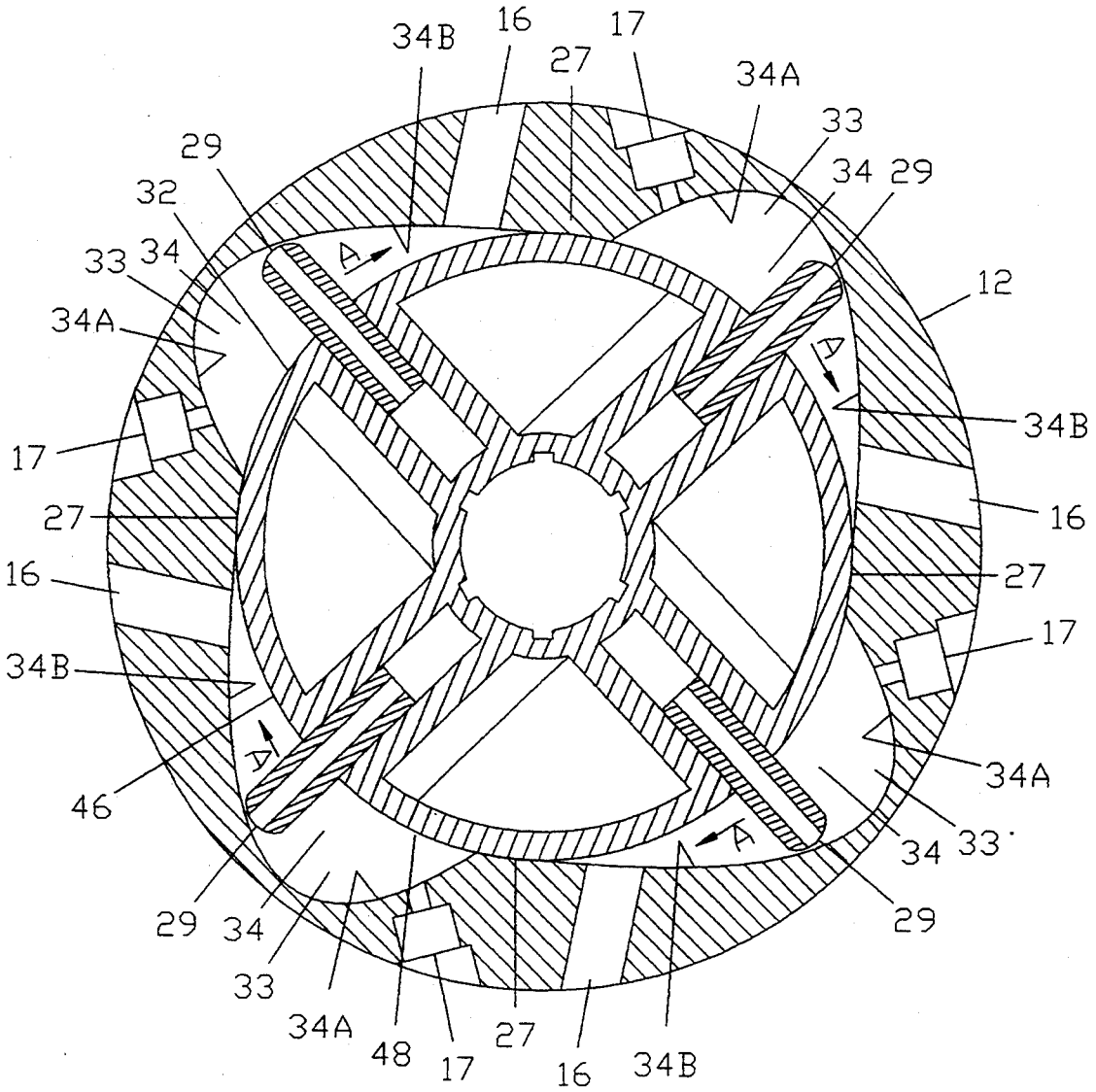
FIG. 2 is a section along the line 2—2 of FIG. 1.

The combustion-exhaust housing sub-section (stator) 12 as shown in FIGS. 1 and 2 is sealed on one side by the rear end casting 11 and on the other side by casting 13 forming a valve body. The casting 12 forms a plurality of combustion chambers and has a lobate interior formed of a plurality of lobes 34, one lobe for each vane. Each of the lobes has a portion 34A with a radius of curvature that decreases and a portion 34B with a radius of curvature that increases in the direction of movement of the vanes 29, and may be a section of an ellipse or of a spiral. However, while such a lobate structure is preferred, circular lobes may be used as an alternative, though believed inferior. The casting 12 is machined to a very fine finish on the inside where the vanes 29 ride and has exhaust ports 16 located at the ends of the portions 34B of each lobe 34 and spark plugs 17 at the opposite end of each lobe 34 at the beginning of portion 34A of each lobe 34 (see FIGS. 1 and 2). The terms beginning and end are defined in relation to the direction of movement of the vanes 29 as indicated by the arrow A.

Figure 4:
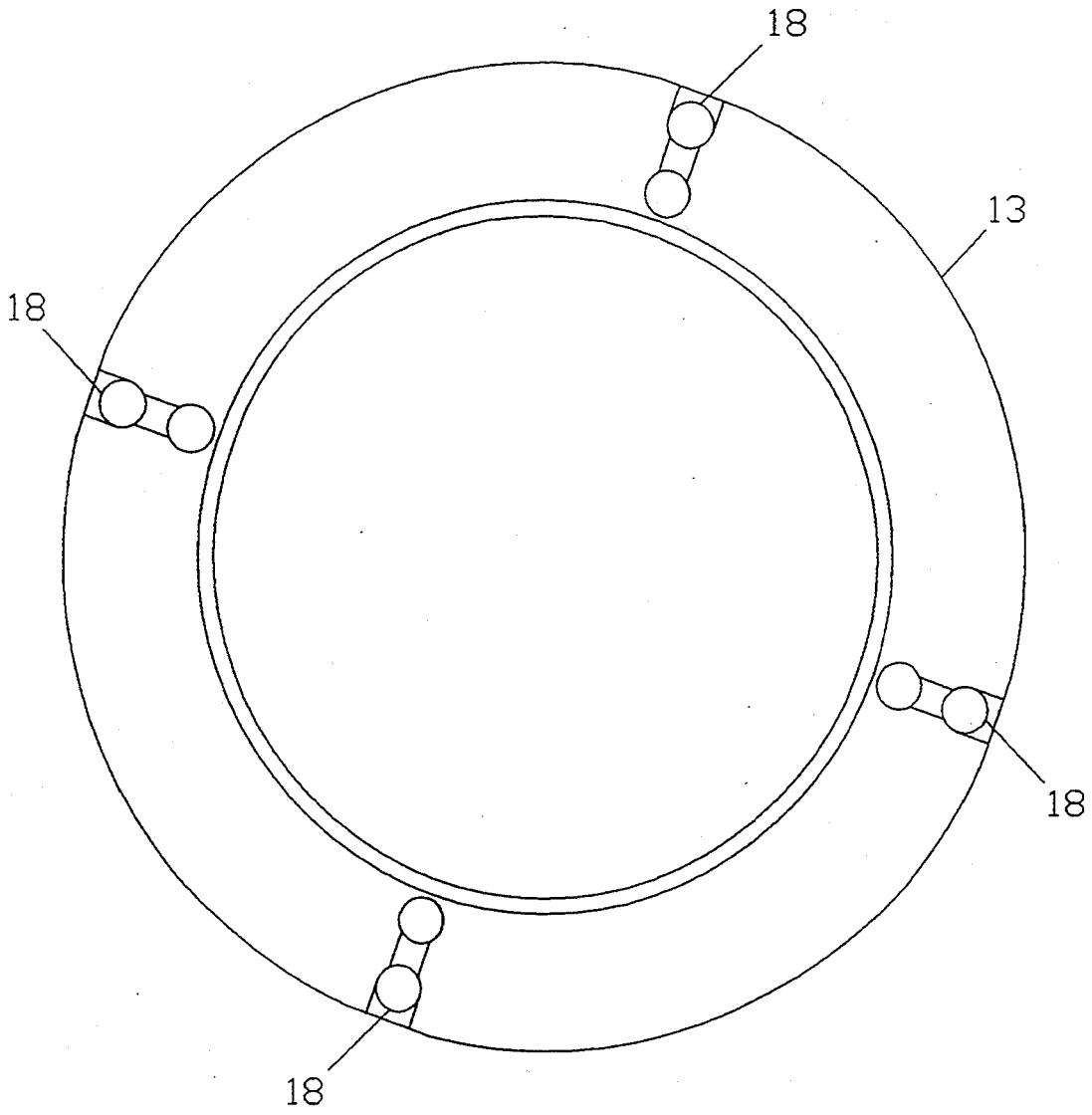
FIG. 4 is a plan view of a valve body for use in the engine of FIG. 1.
Figure 5:
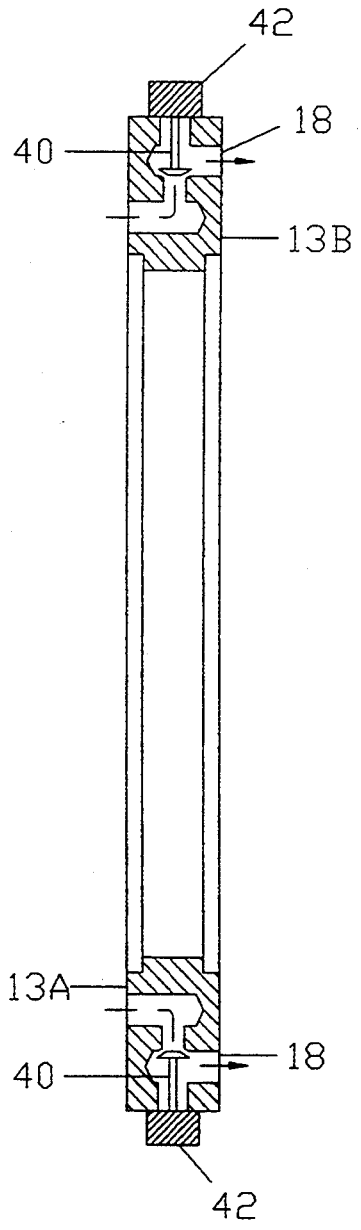
FIG. 5 is a side view of the valve body of FIG. 4 cut away along the line 4—4.

The central casting or valve body 13, shown particularly in FIGS. 4 and 5, is located between the combustion and exhaust chamber casting 12 and the compression and intake chamber casting 14. The valve body 13 is machined to a fine polish on both sides and 13B, one side 13B to seal against one end of the combustion-exhaust chamber 12 and the other side 13A to seal the intake-compression chamber 14. The valve body 13 is also machined with passages 18 as seen in FIG. 4. Within each passage 18 is a valve 40 operated by solenoid 42. The valves 40 are opened and closed by solenoids 42, and are opened only during intake for a short time, in accordance with known practice, to allow the passage of air from the intake side to the combustion side.

Figure 3:
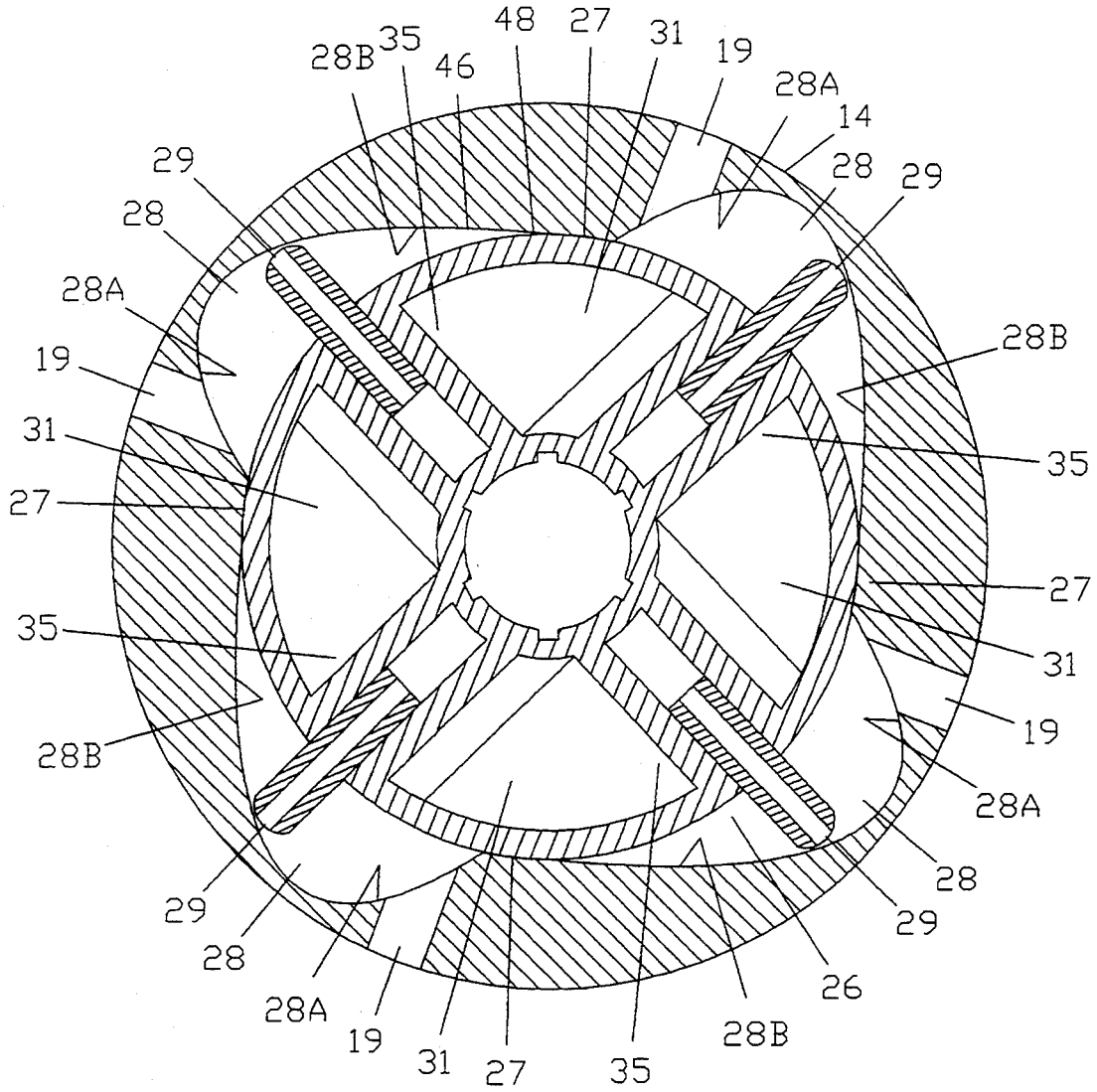
FIG. 3 is a section along the line 3—3 of FIG. 1.

The intake and compression housing or stator 14 (FIGS. 1 and 3) houses the intake and compression chambers 28 with inlet ports at 19 FIGS. 1 and 3. The casting 14 has a lobate interior formed of a plurality of lobes 28, one lobe for each vane 29. Each of the lobes has a portion 28A with a radius of curvature that decreases and a portion 28B with a radius of curvature that increases in the direction of movement of the vanes 29, and may be a section of an ellipse or of a spiral. The inlet ports 19 are holes in the casting 14 leading into the portion 28B of the lobes 28. The chambers formed by the lobes 28 in the stator 14 are sealed on one side by the valve body 13 and on the other side by the front plate or casting 15. The inside of the casting 14 is machined to a very smooth finish where the vanes 29 move and on the two sides where the valve body 13 and the front plate 15 seal the chambers.

Figure 9:
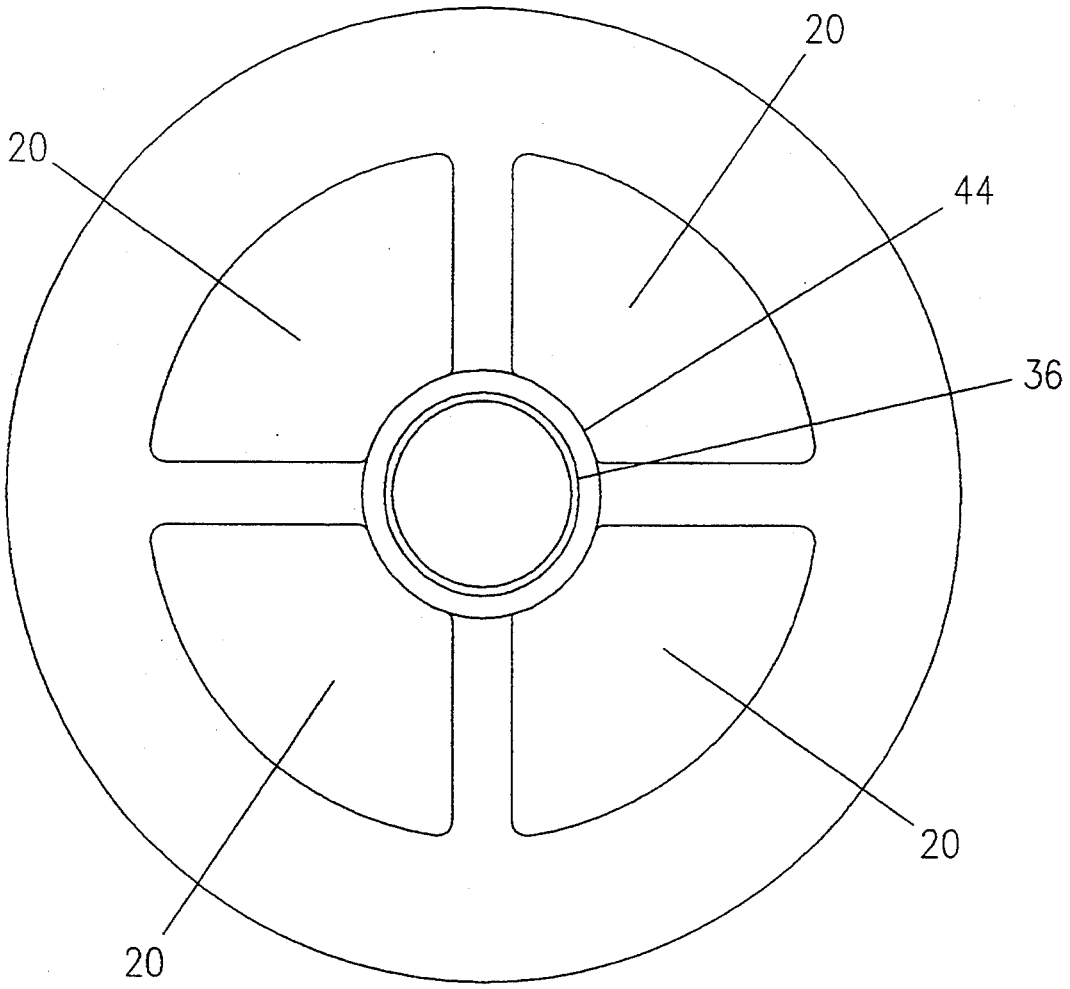
FIG. 9 is an end view of the front plate of the engine.

The front plate 15 seals the front of stator 14 and has four intake ports 20 as shown in FIG. 9. Inside the ports 20 is a collar 44 that houses a front bearing 21 (shown in FIG. 1), the bearing 21 being sealed by seal 36. Bearing 21 together with bearing 25 support the shaft 22. Bearing 25 is a pair of tapered roller bearings that position the shaft 22 longitudinally, while bearing 21 is a simple roller bearing for supporting the end of the shaft 22. The setting of these bearings is done by shims on end plate 24. The front plate 15 is machined in the center to take the bearing 21 and on one side to seal the stator 14.

The rotor 26 is secured for rotation in the intake and compression chambers on a central portion of the shaft 22 and rotates inside the stator 14. There are very close tolerances at points 27 in FIG. 3 between the inside surface of the stator 14 and the outer surface of the rotor 26 which seal one end of each chamber while compression is taking place within space 28B. The other side of the vane 29 is filled with air from the intake port 19 from tubes 38 (See FIGS. 1 and 3) at the same time as compression occurs in space 28B.

The rotor 32 (seen most clearly in FIG. 2) is secured for rotation in the combustion and exhaust stator 12. Combustion in chamber 33 forces the vane 29 to rotate from pressure on one side of the vane 29. The other side of the vane 29 forces the gasses out the port 16.

Both rotors 26 and 32 are made of cast iron and machined to an extremely smooth surface on the outside surface 46 of ring 48. The ring 48 with outer surface 46 is supported by blades 35 distributed about the central axis of the rotors. The blades 35 are so formed (angled) to force air from the atmosphere into the chambers defined by the lobes 28. The blades 35 of each rotor support a plurality of radially disposed vanes 29 which are held in the center of the blades 35. The vanes 29 slide between the blades 35 and are extendable beyond the outer surface 46. Centrifugal force causes each vane 29 to slide within the rotor and follow the contour formed by the surface of the lobes 28 or 34 as the rotor rotates.

Each rotor 26 (FIG. 3) and 32 (FIG. 2) is hollow, within the ring 48, and includes means to force air from the atmosphere into the combustion chamber, namely angled blades 35 oriented to force air in one direction within the rotors.

Air flow is along the axis of the engine as indicated by the arrow B in FIG. 1. Air enters through the end plate 15 through openings 20 in FIG. 9 and is forced along the axis by the blades 35 of the rotors 26 and 32 and then forced out through the rear plate 11 into the tubes 39 via passageway 41 (see FIG. 1). The air flows along tubes 39 and into the intake chambers 28A.

Figure 6:
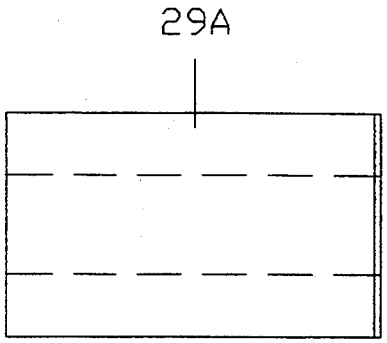
FIG. 6 is a side view of a vane for use in the engine of FIG. 1.
Figure 7:
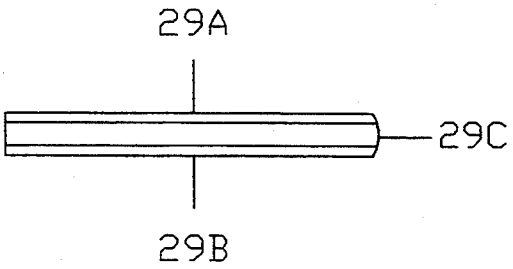
FIG. 7 is another side view of the vane of FIG. 6.
Figure 8:
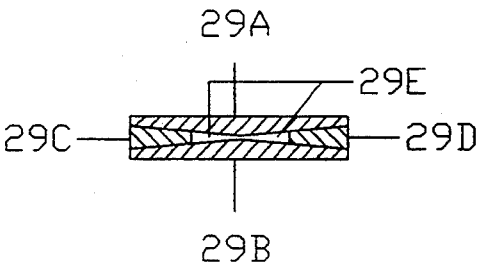
FIG. 8 is an end view of the vane of FIG. 6.

As shown in FIGS. 6, 7 and 8, the vanes 29 are formed from four wedges 29A, 29B, 29C and 29D. The wedges of wedge pair 29C and 29D are wedged between the wedge pair 29A and 29B. Pressure on the side 29A during compression or combustion will cause the pieces 29C and 29D to move outward and into sealing contact with the adjacent sides of the valve body 13 and the sides of the front and rear plates 11 and 15 as the case may be. The interior 29E of the vane is hollow. The vane 29 is thus formed of mutually opposing wedge pairs such that pressure upon one wedge pair forces the other outward.

Care must be taken in the sealing of the chambers, which is mainly provided by the close tolerances at points 27. Lubrication of the combustion and compression chambers may be accomplished through the addition of oil to the fuel mixture. The vanes 29 may be coated with teflon in order to reduce the need for lubrication.

The manufacture of this engine starts with the machining of the shaft 22 from a billet of steel. The rotors 26 and 32 are splined on the shaft 22. At one end, the shaft 22 is extended for use in driving a load and may be extended at the other end as well for auxiliary drive pulleys. The castings 11, 12, 13, 14 and 15 may be made of the same material as the shaft 22. The rear casting 11 is machined to receive the bearings and seals. Air passages 41 are threaded to allow the air tubes 39 to be installed. The front surface of the rear housing 11 is machined to a polished surface to seal one side of the firing chamber. At this time the housing is drilled and tapped for studs.

The front rear seal is installed then the front tapered bearing 25 is installed. The shaft 22 is installed through these two elements. The two bearing races are installed on the shaft. The rear tapered bearing 22 is installed in the housing and the rear bearing retainer and seal is put in place and shimmed to provide a clearance for the bearings.

The rear rotor 32 is machined and polished and slid onto the shaft 22. The vanes 29 are made from four pieces of machine steel formed and polished to close tolerances. These vanes are installed in the rotor 32. The compression stator 12 is machined and polished on the inside, drilled and tapped for spark plugs and exhaust tubes and is then installed on the studs outside of the rotor and in the proper relationship to the rotor.

The valve body 13 is machined and polished on both sides and drilled for air passages. The valve seats and valve threads are machined into it and it is then installed on the studs with proper relationship to the combustion casting 12.

The compression rotor 26 is then installed on the shaft 22 after it has been machined the same as the combustion rotor 26. The compression stator 12 is machined to a polished surface on the inside and on tow sides and it is installed on the studs with proper relationship to the rotor.

The front plate 15 is machined and polished on the side facing the rotor. It is also machined to receive the front bearing 21 and seals. The bearing and seals are installed and the cover is put in place on the studs so it is lined up with the engine.

Nuts are then installed on the studs and torqued to hold the whole assembly together. The fuel injection and electronic ignition (not shown) are then installed.

A person skilled in the art could make immaterial modifications to the invention described and claimed in this patent without departing from the essence of the invention.

I claim:

1. A two stage rotary vaned internal combustion engine comprising:

a compression chamber housing;

a valve body having first and second sides, the first side of the valve body being secured to the compression chamber housing;

a combustion chamber housing secured to the second side of the valve body;

a compression and intake rotor secured for rotation in the compression chamber housing on a central shaft;

a combustion and exhaust rotor secured for rotation in the combustion chamber housing on the central shaft;

each rotor being hollow and including angled radially extending blades oriented to force air in one direction within the rotors from the atmosphere into the compression chamber, through the valve body and into the combustion chamber;

each rotor including an outer surface and a plurality of radially disposed vanes extendable radially beyond the outer surface, the vanes being supported by the radially extending blades;

each of the combustion chamber housing and the compression chamber housing having a lobate interior formed of a plurality of lobes, one lobe for each vane; and each vane being slidable within the rotor during rotation of the rotor into contact with the lobate interior of a respective one of the compression chamber and the combustion chamber.

2. The two stage rotary vaned internal combustion engine of claim 1 in which each of the lobes has a radius of curvature that decreases then increases in the direction of movement of the vanes.

3. A two stage rotary vaned internal combustion engine comprising:

a compression chamber housing;

a valve body having first and second sides, the first side of the valve body being secured to the compression chamber housing;

a combustion chamber housing secured to the second side of the valve body;

a compression and intake rotor secured for rotation in the compression chamber housing on a central shaft;

a combustion and exhaust rotor secured for rotation in the combustion chamber housing on the central shaft;

each rotor including an outer surface and a plurality of radially disposed vanes extendable radially beyond the outer surface;

each of the combustion chamber housing and the compression chamber housing having a lobate interior formed of a plurality of lobes, one lobe for each vane;

each vane being slidable within the rotor during rotation of the rotor into contact with the lobate interior of a respective one compression chamber and the combustion chamber; and each vane being formed of mutually opposing wedge pairs such that pressure upon one wedge pair forces the other outward.

4. The two stage rotary vaned internal combustion engine of claim 3 in which each of the lobes has a radius of curvature that decreases then increases in the direction of movement of the vanes.

5. The two stage rotary vaned internal combustion engine of claim 4 in which each rotor is hollow and includes means to force air from the atmosphere into the compression chamber.

6. The two stage rotary vaned internal combustion engine of claim 5 in which the means for forcing air includes angled radially extending blades oriented to force air in one direction within the rotors.

7. A two stage rotary vaned internal combustion engine comprising:

a compression chamber housing;

a valve body having first and second sides, the first side of the valve body being secured to the compression chamber housing;

a combustion chamber housing secured to the second side of the valve body;

a compression and intake rotor secured for rotation in the compression chamber housing on a central shaft;

a combustion and exhaust rotor secured for rotation in the combustion chamber housing on the central shaft;

each rotor including an outer surface and a plurality of radially disposed vanes extendable radially beyond the outer surface;

each of the combustion chamber housing and the compression chamber housing having a lobate interior formed of a plurality of lobes, one lobe for each vane;

each rotor being hollow and including angled radially extending blades oriented to force air in one direction within the rotors from the atmosphere into the compression chamber; and the vanes being supported by the blades and each vane being slidable within the rotor during rotation of the rotor into contact with the lobate interior of a respective one of the compression chamber and the combustion chamber.

8. The two stage rotary vaned internal combustion engine of claim 7 in which each of the lobes has a radius of curvature that decreases then increases in the direction of movement of the vanes.

* * * * *